US011602020B2

(12) United States Patent
Wang et al.

(10) Patent No.: US 11,602,020 B2
(45) Date of Patent: Mar. 7, 2023

(54) DIMMING SIGNAL GENERATION CIRCUIT, DIMMING SIGNAL GENERATION METHOD AND LED DRIVER

(71) Applicant: Silergy Semiconductor Technology (Hangzhou) LTD, Hangzhou (CN)

(72) Inventors: Longqi Wang, Hangzhou (CN); Jianxin Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 373 days.

(21) Appl. No.: 16/884,227

(22) Filed: May 27, 2020

(65) Prior Publication Data

US 2020/0389950 A1 Dec. 10, 2020

(30) Foreign Application Priority Data

Jun. 6, 2019 (CN) ..... 201910488756.8

(51) Int. Cl.
*H05B 45/10* (2020.01)
*H05B 45/385* (2020.01)
*H05B 45/382* (2020.01)

(52) U.S. Cl.
CPC ..... *H05B 45/10* (2020.01); *H05B 45/382* (2020.01); *H05B 45/385* (2020.01)

(58) Field of Classification Search
CPC .... H05B 45/10; H05B 45/382; H05B 45/385; Y20B 20/30
See application file for complete search history.

(56) References Cited

U.S. PATENT DOCUMENTS

| | | | | |
|---|---|---|---|---|
| 6,075,716 | A | 6/2000 | He et al. | |
| 6,385,057 | B1 | 5/2002 | Barron | |
| 8,471,488 | B1 | 6/2013 | Hopkins et al. | |
| 9,077,260 | B2 | 7/2015 | Zhao et al. | |
| 9,124,169 | B2 | 9/2015 | Garlow et al. | |
| 9,167,645 | B1 * | 10/2015 | Wu | H05B 45/10 |
| 9,462,655 | B1 * | 10/2016 | Davis | H05B 45/10 |
| 9,525,336 | B2 | 12/2016 | Huang | |
| 2009/0243398 | A1 | 10/2009 | Yohanan et al. | |
| 2015/0207398 | A1 | 7/2015 | Proca | |
| 2015/0216007 | A1 | 7/2015 | Ferrara et al. | |
| 2018/0116021 | A1 * | 4/2018 | Jin | H05B 45/30 |
| 2020/0146125 | A1 * | 5/2020 | Jo | H05B 45/392 |
| 2021/0227664 | A1 * | 7/2021 | Li | H05B 45/385 |
| 2022/0191988 | A1 * | 6/2022 | Qiu | H05B 45/20 |

FOREIGN PATENT DOCUMENTS

CN 108093534 A 5/2008

* cited by examiner

*Primary Examiner* — Raymond R Chai

(57) ABSTRACT

A dimming signal generation circuit configured for an LED driver can include: a voltage-type dimmer configured to generate a dimming voltage; a dimming control circuit comprising a transformer and a power switch coupled in series between a first voltage and ground; where a secondary side of the transformer is coupled to the voltage-type dimmer is configured to receive the dimming voltage; where a primary side of the transformer is configured to receive the first voltage; and where a dimming reference signal is generated at the primary side of the transformer in accordance with the dimming voltage.

20 Claims, 8 Drawing Sheets

DIMMING SIGNAL GENERATION CIRCUIT, DIMMING SIGNAL GENERATION METHOD AND LED DRIVER

RELATED APPLICATIONS

This application claims the benefit of Chinese Patent Application No. 201910488756.8, filed on Jun. 6, 2019, which is incorporated herein by reference in its entirety.

FIELD OF THE INVENTION

The present invention generally relates to the field of power electronics, and more particularly to dimming signal generation circuits and methods, and associated LED drivers.

BACKGROUND

A switched-mode power supply (SMPS), or a "switching" power supply, can include a power stage circuit and a control circuit. When there is an input voltage, the control circuit can consider internal parameters and external load changes, and may regulate the on/off times of the switch system in the power stage circuit. Switching power supplies have a wide variety of applications in modern electronics. For example, switching power supplies can be used to drive light-emitting diode (LED) loads.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

With the popularity and application of light-emitting diodes (LEDs) in various industries, higher requirements are required for LED dimming technology. In addition to silicon controlled dimmers for dimming, voltage-type dimmers, such as 0-10V dimmers, are widely applied to adjust the brightness of LEDs due to its constant voltage function within a certain current. The voltage-type dimmer may need to be manually adjusted to achieve dimming, such that the voltage-type dimmer and a dimming circuit/module for driving the LED are typically isolated. In one approach, an isolated voltage converter can be provided to transmit the dimming voltage of the voltage-type dimmer to the dimming circuit/module.

Figure 1:
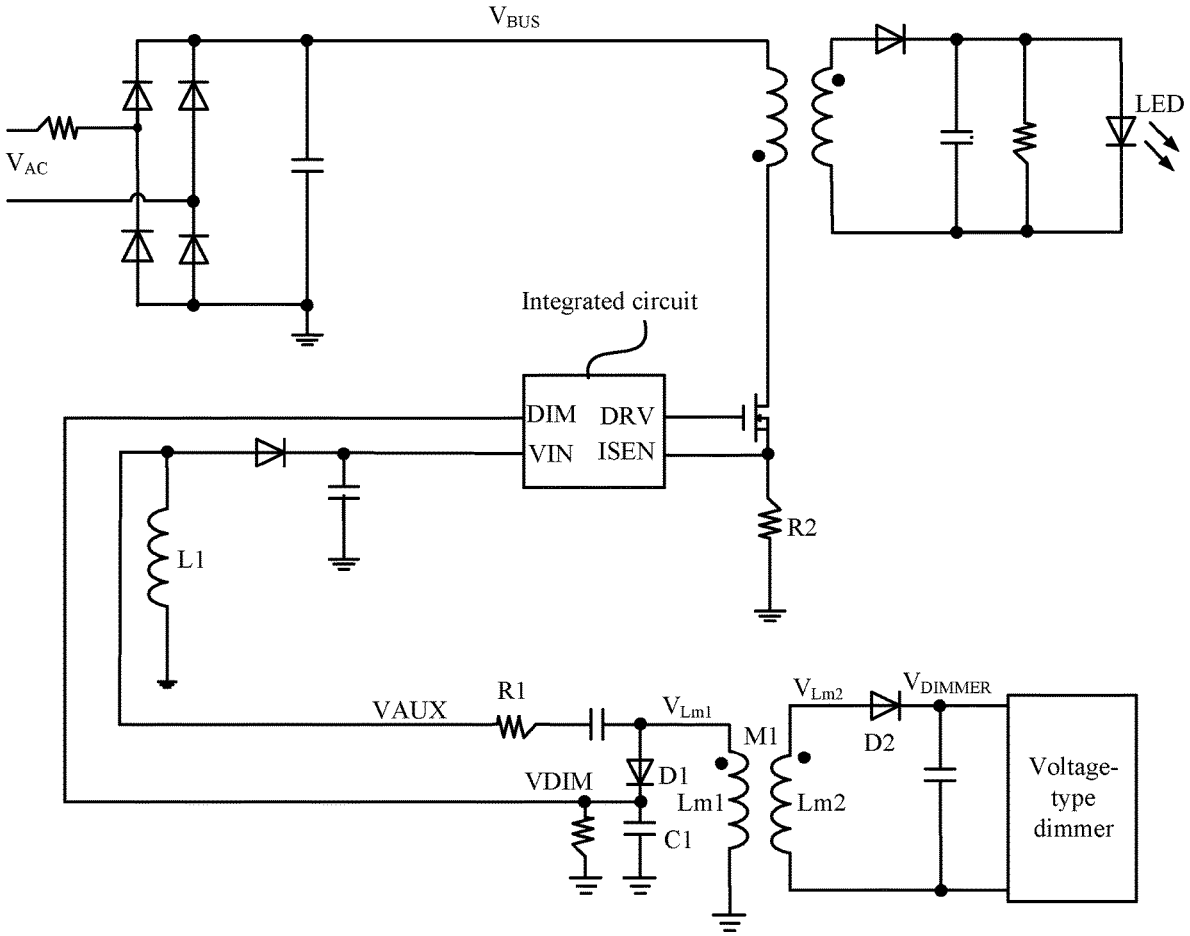
FIG. 1 is a schematic block diagram of an example LED driver.

Referring now to FIG. 1, shown is a schematic block diagram of an example LED driver. In this particular example, a rectifier circuit can convert alternating current signal $V_{AC}$ into direct current signal $V_{BUS}$, and a flyback converter may receive direct current signal $V_{BUS}$ to drive the LED load. The flyback converter can include transformer M1 controlled by auxiliary winding L1. Diode D1 and capacitor C1 can connect in series between primary winding Lm1 of transformer M1 and ground. Secondary winding Lm2 of transformer M1 can connect to the voltage-type dimmer via diode D2. Transformer M1 may operate in a forward state.

Figure 2:
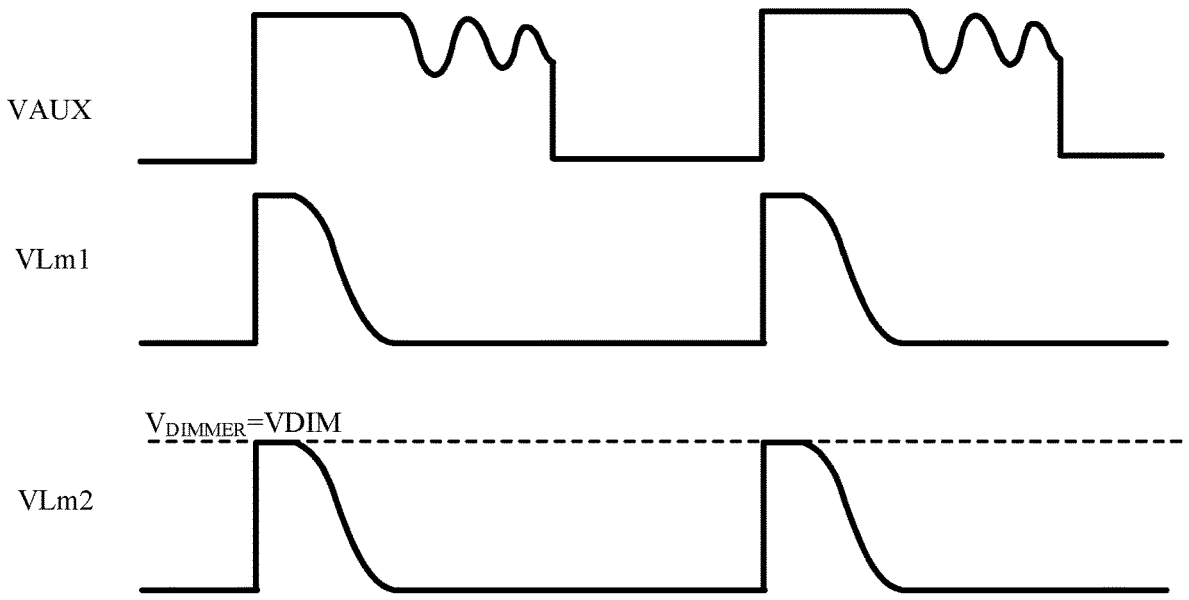
FIG. 2 is a waveform diagram of the example LED drive in FIG. 1.

Referring now to FIG. 2, shown is a waveform diagram of the example LED drive in FIG. 1. The waveforms of voltage VAUX across auxiliary winding L1, voltage VLm1 across primary winding Lm1, and voltage VLm2 across secondary winding Lm2, varying with time are shown from top to bottom. Voltage VLm1 across primary winding Lm1 and voltage VLm2 across secondary winding Lm2 can be proportional. The peak value of voltage VLm2 may be equal to dimming voltage $V_{DIMMER}$ of the voltage-type dimmer. Due to the function of diode D1, voltage VDIM at the common node between diode D1 and capacitor C1 may be equal to the peak value of voltage VLm1, such that voltage VDIM is proportional to dimming voltage $V_{DIMMER}$. In this way, voltage VDIM can be configured as a dimming reference voltage to adjust a current flowing through the LED, in order to complete the dimming.

However, this approach utilizes auxiliary winding L1 to drive transformer M1 through current-limiting resistor R1. In addition, current-limiting resistor R1 may have a relatively large resistance, such that power losses may be large. Further, the LED driver is controlled by an integrated circuit, thus many peripheral devices may need to be provided for generating the dimming reference voltage. Since the current generated by transformer M1 for driving the voltage-type dimmer is inconsistent due to the change of the driving voltage of transformer M1, load capacity of the LED driver can be poor, and the output voltage of the voltage-type dimmer may have deviations, thereby resulting in poor dimming.

In one embodiment, a dimming signal generation circuit configured for an LED driver can include: (i) a voltage-type dimmer configured to generate a dimming voltage; (ii) a dimming control circuit comprising a transformer and a power switch coupled in series between a first voltage and ground; (iii) where a secondary side of the transformer is coupled to the voltage-type dimmer is configured to receive the dimming voltage; (iv) where a primary side of the transformer is configured to receive the first voltage; and (v) where a dimming reference signal is generated at the primary side of the transformer in accordance with the dimming voltage.

Figure 3:
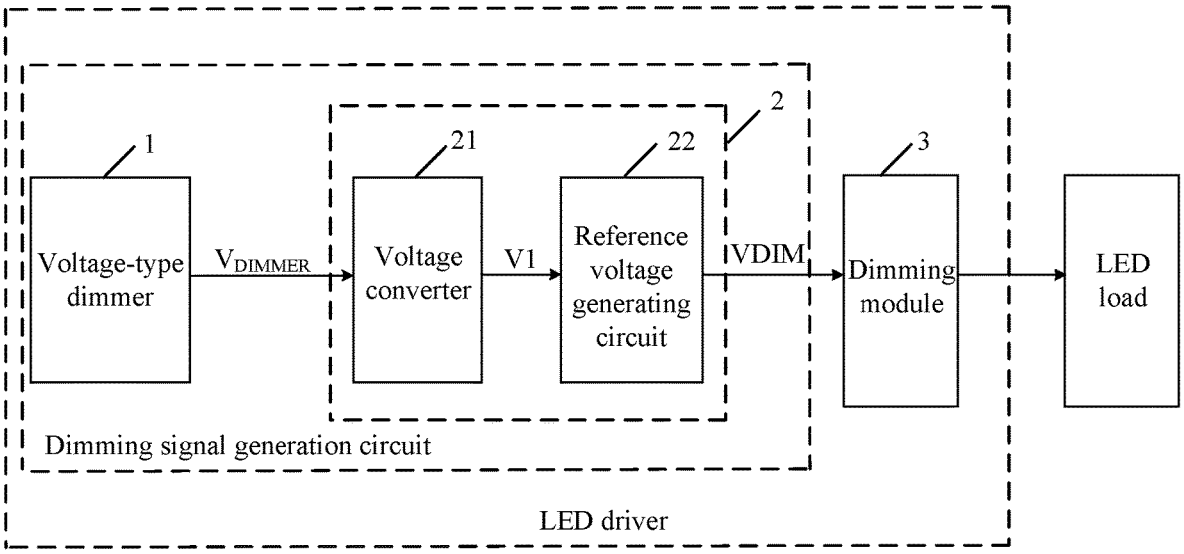
FIG. 3 is a schematic block diagram of a first example LED driver, in accordance with embodiments of the preset invention.

Referring now to FIG. 3, shown is a schematic block diagram of a first example LED driver, in accordance with embodiments of the preset invention. This example LED driver can include a diming signal generation circuit. The diming signal generation circuit can include voltage-type dimmer 1 and dimming control circuit 2. Voltage-type dimmer 1 may generate dimming voltage $V_{DIMMER}$, and dimming control circuit 2 can generate dimming reference signal VDIM in accordance with dimming voltage $V_{DIMMER}$. Further, dimming control circuit 2 may convert dimming voltage $V_{DIMMER}$ to dimming reference signal VDIM by a voltage converter. The voltage converter can include a transformer and a power switch, and dimming voltage $V_{DIMMER}$ can be transmitted from a secondary side to a primary side of the transformer. The LED driver can also include dimming circuit/module 3. Dimming circuit/module 3 can adjust a current flowing through an LED load in accordance with dimming reference signal VDIM, in order to adjust the brightness of the LED load. In this example, voltage dimmer 1 can be an analog dimmer or a resistance dimmer.

In one embodiment, dimming control circuit 2 can include flyback converter 21. The primary side of flyback converter 21 can receive a "first" voltage (e.g., Vin1), and the secondary side of flyback converter 21 can connect to voltage-type dimmer 1. Flyback converter 21 can include a transformer, a power switch, and a rectifier switch. The transformer can include a primary winding and a secondary winding. The secondary winding can connect to voltage-type dimmer 1 via the rectifier switch. The primary winding of the transformer and the power switch can connect in series between voltage Vin1 (see, e.g., FIG. 4) and ground. Dimming reference signal VDIM can be generated in accordance with detection signal V1 representing a voltage across the primary winding of flyback converter 21.

Since voltage-type dimmer 1 has a constant voltage function, when a current starts to flow through the secondary winding of flyback converter 21, a voltage across the secondary winding is equal to dimming voltage $V_{DIMMER}$. Also, a voltage across the primary winding of flyback converter 21 may be proportional to the voltage across the secondary winding. The proportionality factor between the voltage across the primary winding and the voltage across the secondary winding is the ratio between coil turns of the primary winding and the secondary winding. Thus, dimming reference signal VDIM can be generated according to detection signal V1 characterizing the voltage across the primary winding of the transformer in flyback converter 21. This approach can improve the operation efficiency and reduce power losses without a large current limiting resistor, and can be especially suitable and conducive for applications requiring very low standby power loss.

In some cases, voltage Vin1 of flyback converter 21 can be a fixed voltage, which can avoid changes in the current flowing through the secondary winding caused by the change of voltage Vin1. This may also avoid the inconsistency of the drive current of voltage-type dimmer 1, thereby avoiding effecting load capacity of the main circuit due to the inconsistent drive current of voltage-type dimmer 1. Also, the deviation of the output voltage generated by voltage-type dimmer 1 that may be caused by the inconsistent drive current can also be substantially avoided. In one embodiment, dimming control circuit 2 can be fully or partially integrated in an integrated circuit (IC) or chip. For example, dimming control circuit 2 can be integrated separately in one chip, or can be integrated with the control chip of the main circuit in one chip, in order to reduce the peripheral components.

In one embodiment, when the current begins to flow through the secondary winding of flyback converter 21 (e.g., when the power switch is off), the voltage across the primary winding is at its peak value. In this way, dimming reference signal VDIM can be generated directly in accordance with detection signal V1 representing the peak value of the voltage across the primary winding of the transformer in flyback converter 21 when the power switch is off. In another embodiment, dimming reference signal VDIM can also be generated in accordance with detection signal V1 that is representative of the voltage across the primary winding of the transformer in flyback converter 21. The various embodiments can utilize the peak value of the voltage across the primary winding of the transformer for generating dimming reference signal VDIM.

In one embodiment, detection signal V1 that represents the peak value of the voltage across the primary winding in flyback converter 21 can be obtained by sampling. In addition, dimming reference signal VDIM can be generated in accordance with detection signal V1. Further, when voltage Vin1 of flyback converter 21 is substantially fixed, detection signal V1 can be represented by the voltage at the common node between the primary winding and the power switch (see, e.g., FIG. 6). In another embodiment, the voltage across the primary winding may be equal to the difference between voltage Vin1 of flyback converter 21 and the voltage at a common node between the primary winding and the power switch. In this way, dimming reference signal VDIM can be generated in accordance with voltage signal V1 generated by the difference between voltage Vin1 of flyback converter 21 and the voltage at a common node between the primary winding and the power switch, or the voltage at the common node between the primary winding and the power switch.

In particular embodiments, voltage Vin1 can either be fixed (e.g., a constant voltage source) or variable (e.g., changing between high and low voltage levels) and may be a digital or an analog signal, and in any case can complete the dimming as described herein. However, a constant voltage Vin1 is advantageous for dimming. The voltage Vin1 of flyback converter 21 may be obtained from an external circuit, or may be obtained through a main circuit that provides an input voltage to the LED load. In another example, detection signal V1 representative of the peak value of the voltage across the primary winding can be directly configured as dimming reference signal VDIM.

In one embodiment, dimming control circuit 2 can further include reference voltage generating circuit 22. Reference voltage generating circuit 22 may generate dimming reference signal VDIM based on detection signal V1 representative of the peak value of the voltage across the primary winding of the transformer of flyback converter 21. Further, dimming reference signal VDIM may be proportional to detection signal V1. A proportionality coefficient between dimming reference signal VDIM and detection signal V1 can be set according to particular applications. When the proportionality coefficient between dimming reference signal VDIM and detection signal V1 is 1, detection signal V1 can be directly configured as dimming reference signal VDIM. Dimming circuit/module 3 can adjust the current flowing through the LED load according to dimming reference signal VDIM, in order to adjust the brightness of the LED load. Further, dimming circuit/module 3 can linearly adjust the current flowing through the LED load according to dimming reference signal VDIM.

A desired current flowing through the LED load can be represented by dimming reference signal VDIM. Dimming circuit/module 3 can dynamically adjust the current flowing through the LED load to be equal to the desired current represented by dimming reference signal VDIM, in order to linearly adjust the brightness of the LED load. In addition, dimming circuit/module 3 can utilize power dimming, low dropout regulator (LDO) dimming, or any other suitable dimming approach. Various embodiments may linearly adjust the current flowing through the LED load according to dimming reference signal VDIM. It should be understood that the ratio between coil turns of the primary winding and the secondary winding of the transformer can be set according to particular applications. The ratio between the coil turns of the primary winding and secondary winding may be configured as 1:1, for example.

Figure 4:
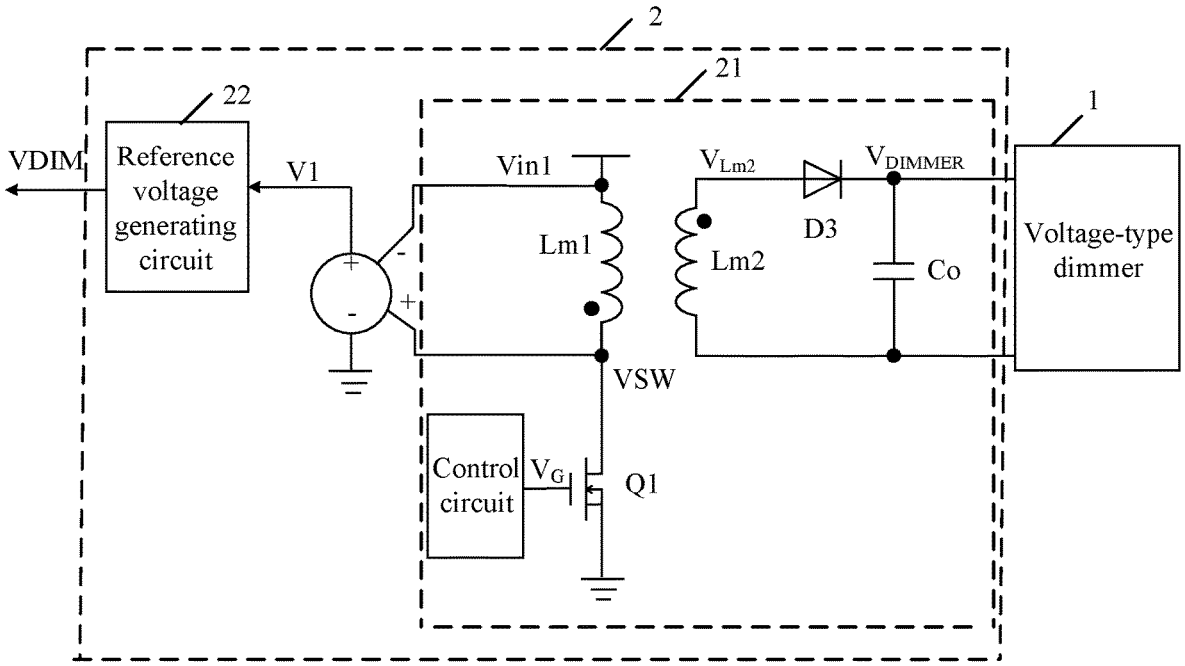
FIG. 4 is a schematic block diagram of a first example dimming control circuit, in accordance with embodiments of the preset invention.

Referring now to FIG. 4, shown is a schematic block diagram of a first example dimming control circuit, in accordance with embodiments of the preset invention. This example dimming control circuit 2 can include flyback converter 21. Flyback converter 21 can include a transformer, power switch Q1, rectifier switch D3, and output capacitor Co. The transformer can include primary winding Lm1 and secondary winding Lm2. Secondary winding Lm2 can connect to voltage-type dimmer 1 via rectifier switch D3. Primary winding Lm1 of the transformer and power switch Q1 can connect in series between voltage Vin1 and ground, and common node SW may be between primary winding Lm1 and power switch Q1. The dotted terminal of secondary winding Lm2 can connect to an anode of rectifier switch D3, and the dotted terminal of primary winding Lm1 can connect to power switch Q1. A non-dotted terminal of primary winding Lm1 can connect voltage Vin1. The ratio between coil turns of the primary winding and the secondary winding may be configured as 1:1. Dimming reference signal VDIM can be generated in accordance with a peak value of the voltage across primary winding Lm1 of the transformer. In this example, voltage Vin1 can be obtained from the main circuit.

Figure 5:
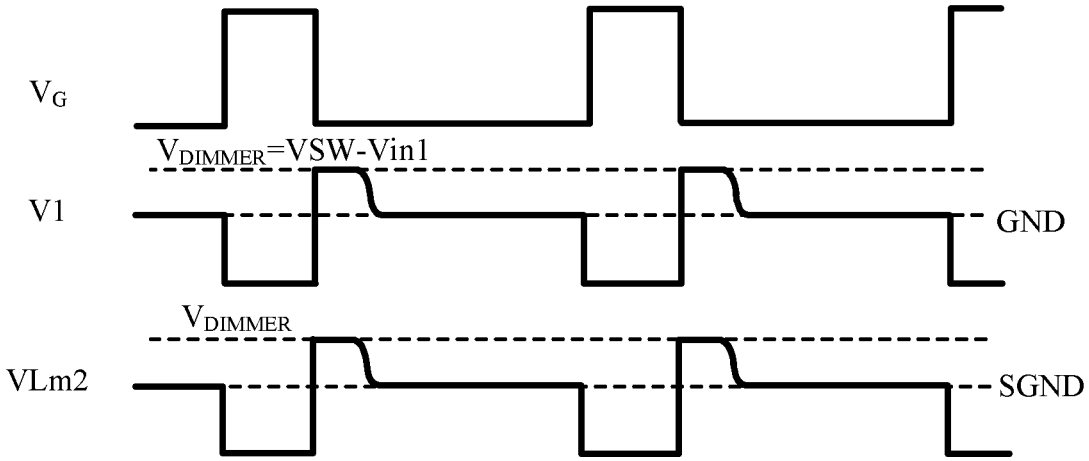
FIG. 5 is a waveform diagram of example operation of the dimming signal generation circuit, in accordance with embodiments of the preset invention.

Referring now to FIG. 5, shown is a waveform diagram of example operation of the dimming signal generation circuit, in accordance with embodiments of the preset invention. In this example, power switch Q1 can be controlled by drive signal $V_G$, and drive signal $V_G$ (e.g., a pulse-width modulation signal) may be generated by a control circuit. When drive signal $V_G$ is at a high level, power switch Q1 can be turned on, the voltage at the dotted terminal of secondary winding Lm2 may be large, and rectifier switch D3 may not be turned on. When drive signal $V_G$ is at a low level, power switch Q1 can be turned off, and rectifier switch D3 may be turned on. Due to the constant voltage function of voltage-type dimmer 1, voltage VLm2 across secondary winding Lm2 can be equal to dimming voltage $V_{DIMMER}$ generated by voltage-type dimmer 1.

Since the ratio between coil turns of primary winding Lm1 and secondary winding Lm2 is 1:1 in this example, the voltage on primary winding Lm1 may also be equal to dimming voltage $V_{DIMMER}$ generated by voltage-type dimmer 1. Also, the voltage on primary winding Lm1 may be equal to the difference between voltage Vin1 and the voltage at common node SW, that is, $VSW-Vin1=V_{DIMMER}$. The peak value of the voltage across primary winding Lm1 may be equal to the peak value of the voltage across secondary winding Lm2, and the peak value of the voltage across secondary winding Lm2 can be equal to dimming voltage $V_{DIMMER}$ generated by voltage-type dimmer 1. In this way, dimming reference signal VDIM can be generated in accordance with the peak value of the voltage across primary winding Lm1.

In one embodiment, dimming control circuit 2 can further include a sampling circuit, a difference circuit, a holding circuit (not shown in FIG. 4), and reference voltage generation circuit 22. The sampling circuit can sample voltage VSW at common node SW. The difference circuit can generate a difference signal between sampled voltage VSW and voltage Vin1. The holding circuit can hold the peak value of the difference signal. Reference voltage generation circuit 22 can receive the peak value of the difference signal, and may generate dimming reference signal VDIM according to the peak value of the difference signal. Further, dimming reference signal VDIM may be proportional to the peak value of the difference signal. The scaling factor between dimming reference signal VDIM and the peak value of the difference signal can be set according to the particular applications. In another embodiment, reference voltage generation circuit 22 may not be needed, and the difference signal generated by the difference circuit may be directly used as dimming reference signal VDIM.

Figure 6:
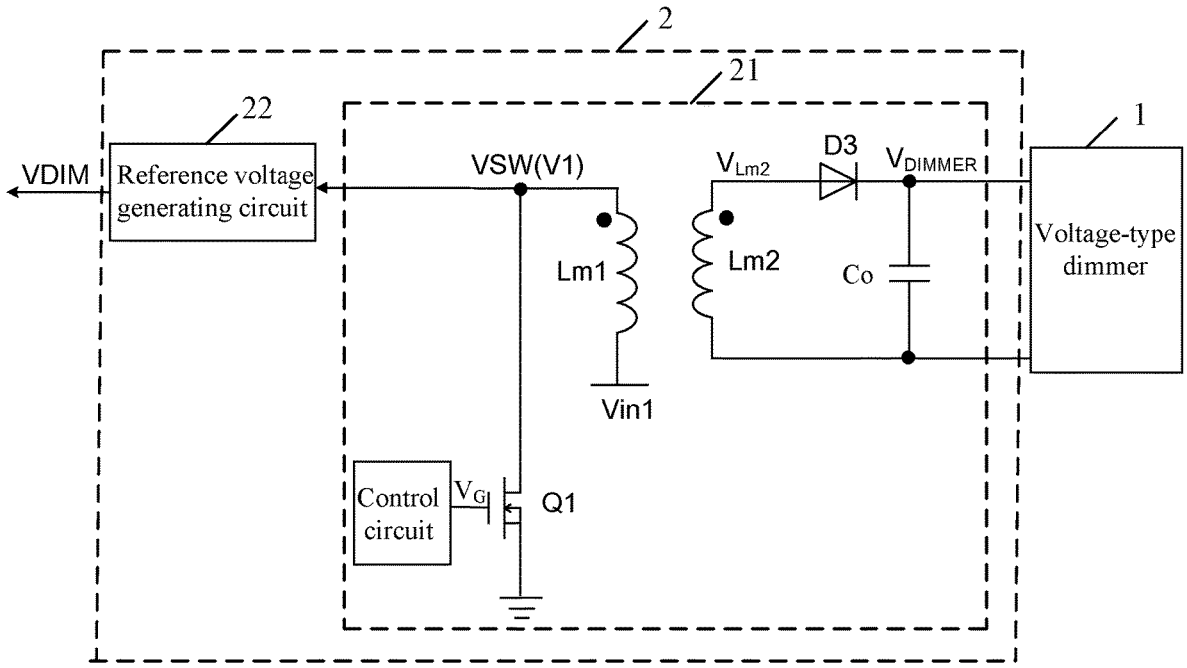
FIG. 6 is a schematic block diagram of a second example dimming control circuit, in accordance with embodiments of the preset invention.

Referring now to FIG. 6, shown is a schematic block diagram of a second example dimming control circuit, in accordance with embodiments of the preset invention. This example dimming control circuit 2 can include flyback converter 21. Flyback converter 21 can include a transformer, power switch Q1, and rectifier switch D3. The transformer can include primary winding Lm1 and secondary winding Lm2. Secondary winding Lm2 can connect to voltage-type dimmer 1 via rectifier switch D3. Primary winding Lm1 of the transformer and power switch Q1 can connect in series between voltage Vin1 and ground, and common node SW can be configured as a node between primary winding Lm1 and power switch Q1. The dotted terminal of secondary winding Lm2 can connect to an anode of rectifier switch D3, and the dotted terminal of primary winding Lm1 can connect to common node SW. The ratio between coil turns of the primary winding and the secondary winding is configured as 1:1 in this example. Dimming reference signal VDIM can be generated by sampling the voltage at common node SW. In addition, voltage Vin1 can be fixed or variable, and can be obtained from the main circuit.

Since the peak value of the voltage across primary winding Lm1 is equal to the peak value of the voltage across secondary winding Lm2 in this example, the peak value of the voltage across secondary winding Lm2 can be equal to dimming voltage $V_{DIMMER}$ generated by voltage-type dimmer 1. In this way, dimming reference signal VDIM can be generated in accordance with the peak value of the voltage across primary winding Lm1. The voltage across primary winding Lm1 may be equal to the difference between voltage Vin1 and the voltage at common node SW, such that dimming reference signal VDIM can be generated in accordance with the voltage at common node SW when voltage Vin1 is fixed.

In this particular example, the dimming control circuit can generate dimming reference signal VDIM in accordance with the voltage at common node SW, voltage Vin1 may not need to be sampled, and the difference circuit may be omitted, such that the structure of the dimming control circuit is simplified. For example, the dimming control circuit here can further include a sample-and-hold circuit (not shown in FIG. 6), which can sample the voltage at common node SW, and hold the peak value of the voltage at common node SW. Reference voltage generation circuit 22 can receive the voltage at common node SW, and may generate dimming reference signal VDIM according to the voltage at common node SW. Further, dimming reference signal VDIM can be proportional to the voltage at common node SW. The scaling factor between dimming reference signal VDIM and the voltage at common node SW can be set according to the particular applications. In another embodiment, reference voltage generation circuit 22 may not be needed, and the voltage at common node SW generated by the sample-and-hold circuit may be directly used as dimming reference signal VDIM.

Figure 7:
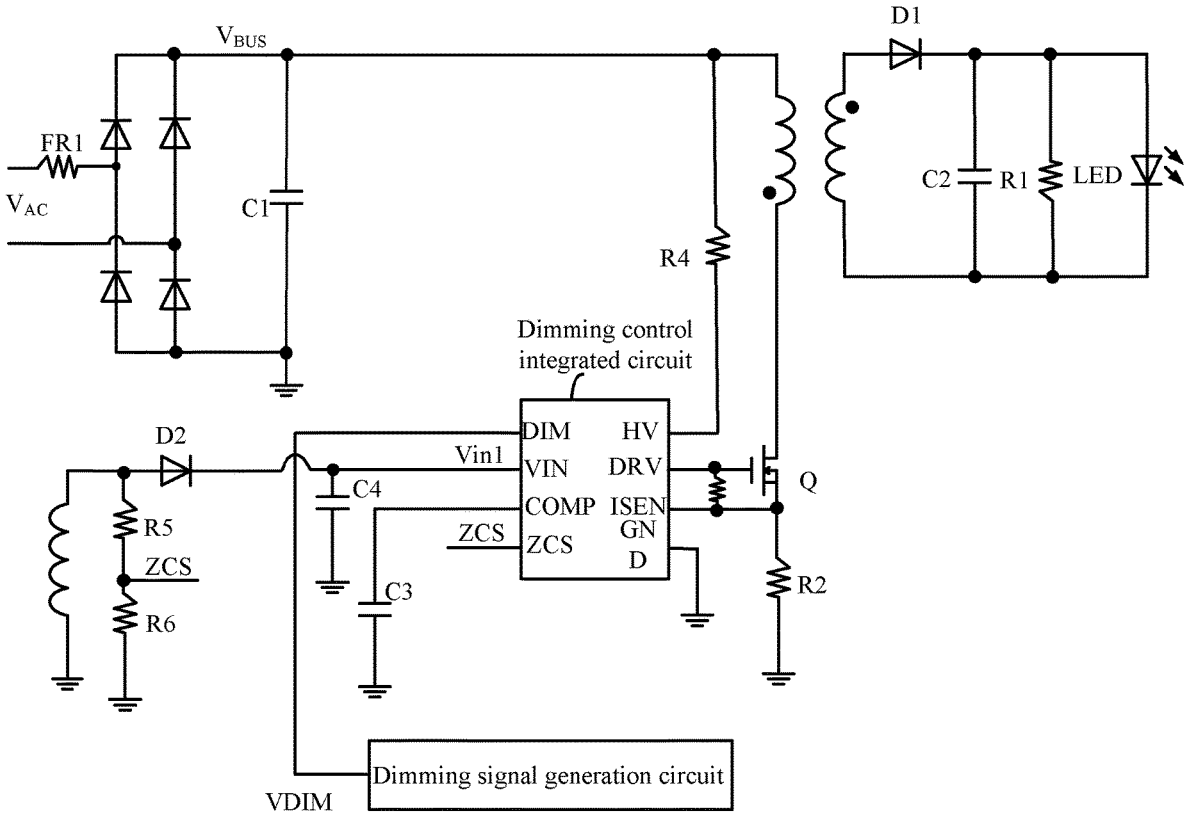
FIG. 7 is a schematic block diagram of a second example LED driver, in accordance with embodiments of the preset invention.

Referring now to FIG. 7, shown is a schematic block diagram of a second example LED driver, in accordance with embodiments of the preset invention. This particular example LED driver for driving an LED load can include the dimming signal generation circuit, a dimming circuit/module, a rectifier circuit, a filter circuit, a dimming integrated circuit, and a switch-type converter. The dimming signal generation circuit can include dimming control circuit 2. The rectifier circuit is a full-bridge rectifier circuit in this example, which can convert alternating current signal $V_{AC}$ into direct current signal $V_{BUS}$. The filter circuit can include capacitor C1 to filter the output signal of the rectifier circuit. The input terminal of the switch-type converter can connect to the output terminal of the rectifier circuit, and the output terminal of the switch-type converter can connect an LED load for power supply. The switch-type converter can be configured as a flyback converter.

For example, the dimming circuit/module in the LED driver can be configured as an integrated circuit to control the switch-type converter. Further, dimming circuit/module 3 can be integrated separately in the dimming integrated circuit. The dimming integrated circuit can include supply voltage pin VIN for receiving voltage Vin1, dimming pin DIM for receiving dimming reference signal VDIM, and an output pin DRV for controlling power transistor Q of the flyback converter. The dimming integrated circuit can adjust a current flowing through the LED load in accordance with dimming reference signal VDIM, in order to adjust brightness of the LED load. In another embodiments, dimming circuit/module 3 can be integrated with at least one of power switch Q and a reference voltage generating circuit in the dimming integrated circuit, in order to reduce peripheral devices.

In one embodiment, a dimming signal generation method of controlling a dimming signal generation circuit, wherein the dimming signal generation circuit comprises a voltage-type dimmer and a dimming control circuit having a transformer and a power switch coupled in series between a first voltage and ground, can include: (i) generating a dimming voltage by the voltage-type dimmer in accordance with a brightness of an LED load; (ii) receiving the dimming voltage by a secondary side of the transformer; (iii) receiving the first voltage by a primary side of the transformer; and (iv) generating a dimming reference signal in accordance with the dimming voltage at the primary side of the transformer in the dimming control circuit.

Figure 8:
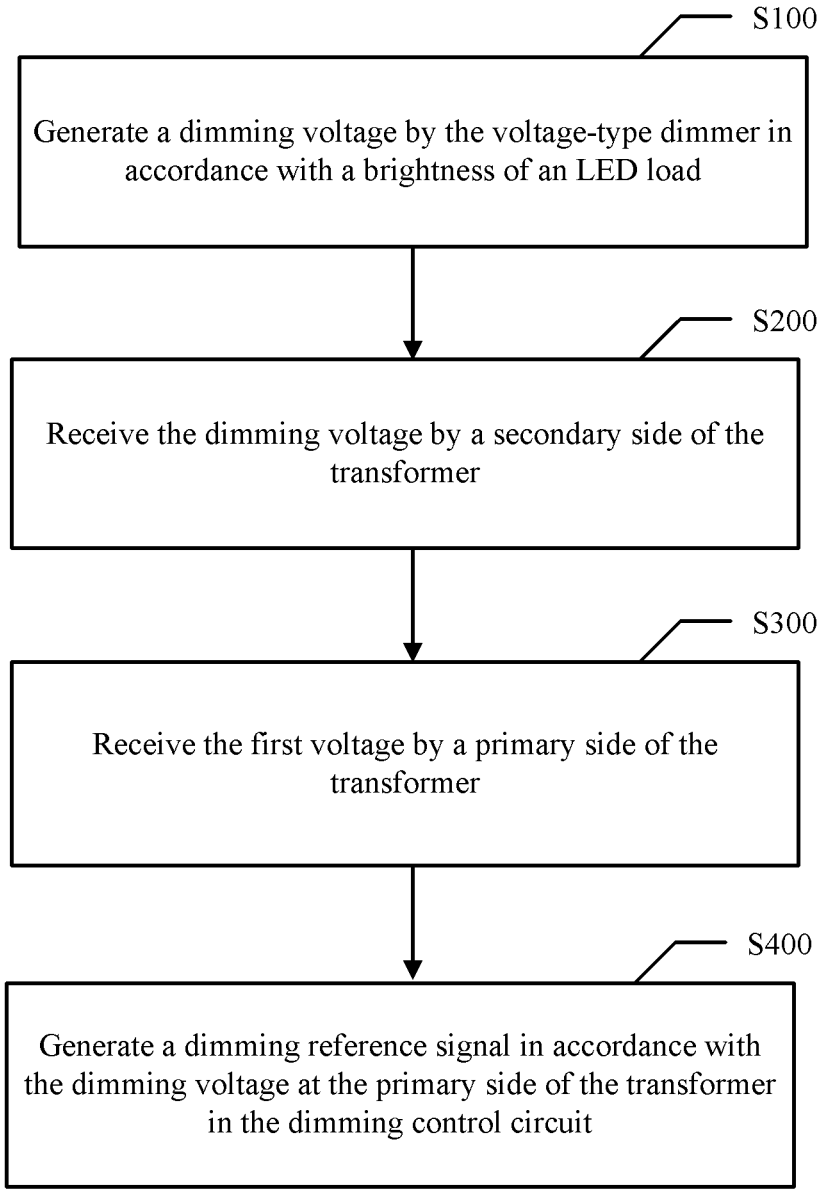
FIG. 8 is a flow diagram of an example dimming signal generation method, in accordance with embodiments of the preset invention.

Referring now to FIG. 8, shown is a flow diagram of an example dimming signal generation method, in accordance with embodiments of the preset invention. The dimming signal generation circuit can include a voltage-type dimmer and a dimming control circuit, and the dimming control circuit can include a transformer and a power switch coupled in series between a first voltage and ground. At S100, a dimming voltage can be generated by the voltage-type dimmer in accordance with brightness of an LED load. At S200, a secondary side of the transformer can receive the dimming voltage. At S300, a primary side of the transformer can receive the first voltage (e.g., Vin1). At S400, a dimming reference signal can be generated at the primary side of the transformer in accordance with the dimming voltage.

Further, an LED driver can adjust a current flowing through the LED load in accordance with the dimming reference signal, in order to adjust the brightness of the LED load. In one embodiment, the dimming reference signal may be generated in accordance with a detection signal representative of a voltage across a primary winding of the transformer. Further, the dimming reference signal can be generated in accordance with a detection signal representative of a peak value of the voltage across the primary winding of the transformer. In addition, the detection signal can be directly configured as the dimming reference signal.

In one embodiment, the detection signal may be generated by sampling a voltage at a common node between the primary winding of the transformer and the power switch, where the first voltage is constant, and the dimming reference signal is proportional to the detection signal. In another embodiment, detection signal may be generated in accordance with a difference between the first voltage and a voltage at the common node between the primary winding of the transformer and the power switch, where the dimming reference signal is proportional to the detection signal. A desired current flowing through the LED load can be represented by the dimming reference signal, and the current flowing through the LED load can be dynamically adjusted to be equal to the desired current represented by the dimming reference signal, in order to linearly adjust the brightness of the LED load.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. A dimming signal generation circuit configured for a light-emitting diode (LED) driver, the dimming signal generation circuit comprising:

a voltage-type dimmer configured to generate a dimming voltage;

a dimming control circuit comprising a transformer and a power switch coupled in series between a first voltage and ground;

wherein a secondary side of the transformer is coupled to the voltage-type dimmer is configured to receive the dimming voltage;

wherein a primary side of the transformer is configured to receive the first voltage;

wherein a dimming reference signal is generated at the primary side of the transformer in accordance with the dimming voltage; and wherein a non-dotted terminal of a primary winding of the transformer is configured to receive the first voltage, a dotted terminal of the primary winding of the transformer is coupled to the power switch, and a dotted terminal of a secondary winding of the transformer is coupled to a high potential output terminal of the voltage-type dimmer.

2. The dimming signal generation circuit of claim 1, wherein the dimming reference signal is generated in accordance with a detection signal representative of a peak value of a voltage across the primary winding of the transformer when the power switch is off.

3. The dimming signal generation circuit of claim 1, wherein the dimming reference signal is generated in accordance with a detection signal representative of a voltage across a primary winding of the transformer when the power switch is off.

4. The dimming signal generation circuit of claim 1, wherein when the power switch is off, a peak value of a voltage across a primary winding of the transformer is configured as the dimming reference signal.

5. The dimming signal generation circuit of claim 1, wherein the dimming control circuit further comprises a reference voltage generating circuit configured to generate the dimming reference signal in accordance with a detection signal representative of a peak value of a voltage across a primary winding of the transformer, wherein the dimming reference signal is proportional to the detection signal.

6. The dimming signal generation circuit of claim 2, wherein the detection signal is generated by sampling a voltage at a common node between the primary winding of the transformer and the power switch, and the first voltage is constant.

7. The dimming signal generation circuit of claim 2, wherein the detection signal is generated in accordance with a difference between the first voltage and a voltage at a common node between the primary winding of the transformer and the power switch.

8. The dimming signal generation circuit of claim 1, wherein the dimming control circuit further comprises:

a rectifier switch coupled between a secondary winding of the transformer and a high potential output terminal of the voltage-type dimmer; and an output capacitor coupled between the rectifier switch and a low potential output terminal of the voltage-type dimmer.

9. The dimming signal generation circuit of claim 1, wherein the voltage-type dimmer is configured as an analog dimmer.

10. The dimming signal generation circuit of claim 1, wherein the voltage-type dimmer is configured as a resistance dimmer.

11. An LED driving apparatus, comprising the LED driver and the dimming signal generation circuit of claim 1, and further comprising a dimming integrated circuit comprising a dimming circuit configured to adjust a current flowing through the LED load in accordance with the dimming reference signal, in order to adjust brightness of the LED load.

12. The LED driving apparatus of claim 11, wherein:

the dimming integrated circuit is configured as an integrated chip;

the dimming circuit is integrated in the dimming integrated circuit; and the dimming integrated circuit comprises a supply voltage pin for receiving the first voltage, a dimming pin for receiving the dimming reference signal, and an output pin coupled to the power switch.

13. The LED driving apparatus of claim 11, wherein:

the dimming integrated circuit is configured as an integrated chip;

the dimming circuit is integrated with at least one of the power switch and a reference voltage generating circuit in the dimming integrated circuit; and the dimming integrated circuit comprises a supply voltage pin for receiving the first voltage, a dimming pin for receiving the dimming reference signal, and an output pin coupled to the power switch.

14. The LED driving apparatus of claim 11, further comprising:

a rectifier circuit configured to convert an alternating current signal into a direct current signal;

a filter circuit configured to filter the direct current signal generated by the rectifier circuit; and a switch-type converter controlled by the dimming integrated circuit, and being configured to drive the LED load.

15. A dimming signal generation method of controlling a dimming signal generation circuit, wherein the dimming signal generation circuit comprises a voltage-type dimmer and a dimming control circuit having a transformer and a power switch coupled in series between a first voltage and ground, the method comprising:

generating a dimming voltage by the voltage-type dimmer in accordance with a brightness of a light-emitting diode (LED) load;

receiving the dimming voltage by a secondary side of the transformer;

receiving the first voltage by a primary side of the transformer;

generating a dimming reference signal in accordance with the dimming voltage at the primary side of the transformer in the dimming control circuit; and generating a detection signal by sampling a voltage at a common node between the primary winding of the transformer and the power switch, wherein the first voltage is constant.

16. The method of claim 15, wherein the dimming reference signal is generated in accordance with the detection signal, and the detection signal is representative of a peak value of a voltage across the primary winding of the transformer when the power switch is off.

17. The method of claim 15, wherein the dimming reference signal is generated in accordance with the detection signal, and the detection signal is representative of a voltage across a primary winding of the transformer when the power switch is off.

18. The method of claim 15, wherein a non-dotted terminal of a primary winding of the transformer is configured to receive the first voltage, a dotted terminal of the primary winding of the transformer is coupled to the power switch, and a dotted terminal of a secondary winding of the transformer is coupled to a high potential output terminal of the voltage-type dimmer.

19. A dimming signal generation method of controlling a dimming signal generation circuit, wherein the dimming signal generation circuit comprises a voltage-type dimmer and a dimming control circuit having a transformer and a power switch coupled in series between a first voltage and ground, the method comprising:

generating a dimming voltage by the voltage-type dimmer in accordance with a brightness of a light-emitting diode (LED) load;

receiving the dimming voltage by a secondary side of the transformer;

receiving the first voltage by a primary side of the transformer;

generating a dimming reference signal in accordance with the dimming voltage at the primary side of the transformer in the dimming control circuit; and generating a detection signal in accordance with a difference between the first voltage and a voltage at the common node between the primary winding of the transformer and the power switch.

20. The method of claim 19, wherein a non-dotted terminal of a primary winding of the transformer is configured to receive the first voltage, a dotted terminal of the primary winding of the transformer is coupled to the power switch, and a dotted terminal of a secondary winding of the transformer is coupled to a high potential output terminal of the voltage-type dimmer.

* * * * *